US009427616B2

(12) United States Patent
Natee et al.

(10) Patent No.: US 9,427,616 B2
(45) Date of Patent: Aug. 30, 2016

(54) PORTABLE ELASTIC RESISTANCE DEVICE FOR EXERCISING THE SKELETAL MUSCLES

(71) Applicants: Daniel D. Natee, Victoria (CA); J. Douglas Prentice, Victoria (CA)

(72) Inventors: Daniel D. Natee, Victoria (CA); J. Douglas Prentice, Victoria (CA)

( * ) Notice: Subject to any disclaimer, the term of this patent is extended or adjusted under 35 U.S.C. 154(b) by 223 days.

(21) Appl. No.: 14/365,147

(22) PCT Filed: Mar. 12, 2013

(86) PCT No.: PCT/CA2013/050186
§ 371 (c)(1),
(2) Date: Jun. 13, 2014

(87) PCT Pub. No.: WO2013/134875
PCT Pub. Date: Sep. 19, 2013

(65) Prior Publication Data

US 2015/0024910 A1 Jan. 22, 2015

Related U.S. Application Data

(60) Provisional application No. 61/609,720, filed on Mar. 12, 2012.

(51) Int. Cl.

| | |
|---|---|
| ***A63B 21/00*** | (2006.01) |
| ***A63B 21/055*** | (2006.01) |
| ***A63B 9/00*** | (2006.01) |
| ***A63B 21/04*** | (2006.01) |

(52) U.S. Cl.
CPC ..... *A63B 21/0552* (2013.01); *A63B 9/00* (2013.01); *A63B 21/00065* (2013.01); *A63B 21/0428* (2013.01); *A63B 21/0557* (2013.01); *A63B 2009/004* (2013.01)

(58) Field of Classification Search
CPC ..... A63B 21/00
USPC ..... 482/121, 35, 37, 23
See application file for complete search history.

(56) References Cited

U.S. PATENT DOCUMENTS

| | | | | |
|---|---|---|---|---|
| 6,887,009 | B1 | 5/2005 | Lopez | |
| 7,041,041 | B1 * | 5/2006 | Evans | A63B 21/0004 482/121 |
| 7,448,990 | B2 | 11/2008 | Wu | |
| 7,951,047 | B2 * | 5/2011 | Kohler | A63B 9/00 482/23 |
| 2003/0162610 | A1 | 8/2003 | Wilson | |
| 2004/0116254 | A1 * | 6/2004 | Kohler | A63B 9/00 482/35 |
| 2009/0239712 | A1 * | 9/2009 | Van Raalte | A63B 69/0048 482/35 |

* cited by examiner

*Primary Examiner* — Jerome W Donnelly
(74) *Attorney, Agent, or Firm* — Davis & Bujold PLLC; Michael J. Bujold

(57) ABSTRACT

The invention consists of a flexible hexagonal array composed of rigid plastic rings, sized and shaped for convenient gripping with the hands, and or pinning against floor or wall by other body parts (feet, knees, elbows, trunk, bead, etc.) each connected to 3 to 6 lengths of bungee, or equivalent elastic material, located at 60 degree intervals around the ring circumference. The array is sized for convenient use for exercise purposes, and is light enough to be readily portable, and, by virtue of its uniform stretch resistance properties, which vary with the number of strands being stretched, and the distance between gripping and/or pinning points, which controls the length of bungee being stretched, gives the opportunity of exercising all of the skeletal muscles, at a variety of resistance levels.

17 Claims, 10 Drawing Sheets

FIGURE 6
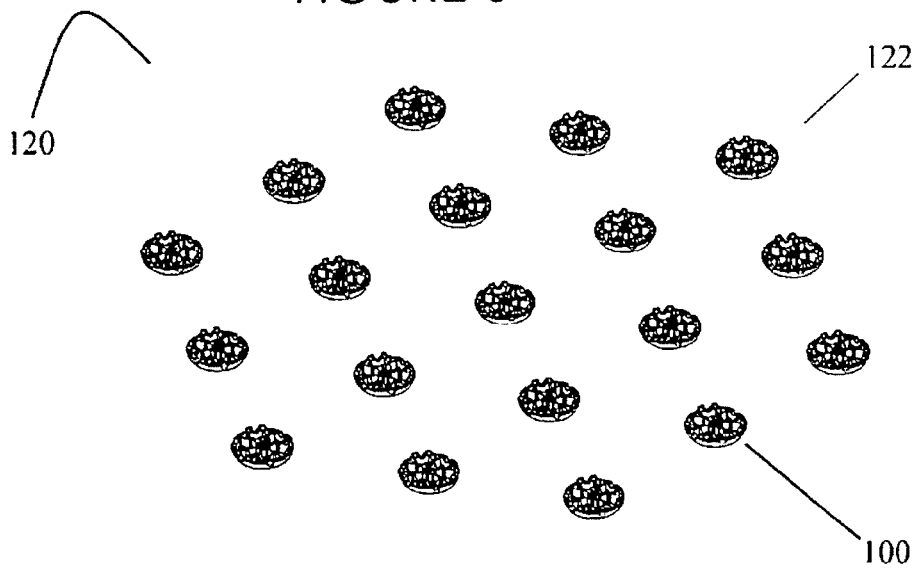
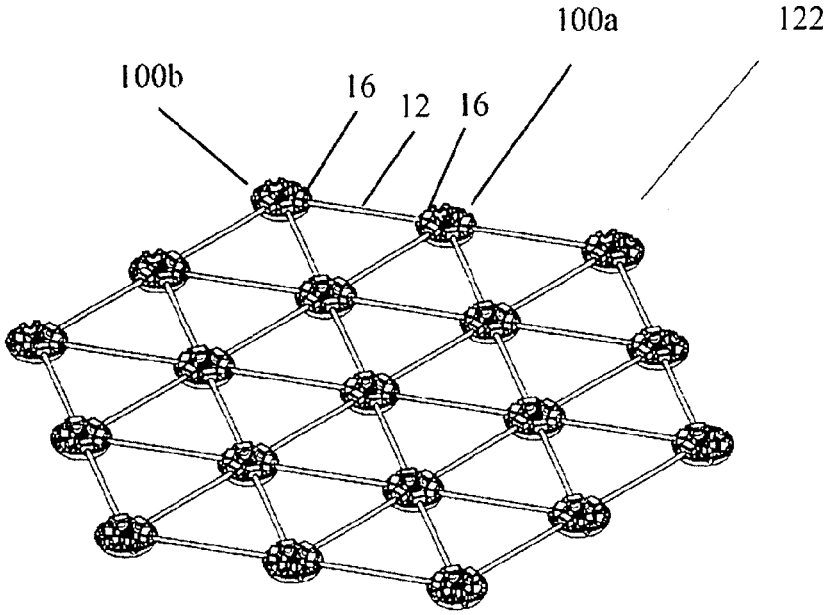
FIGURE 7

PORTABLE ELASTIC RESISTANCE DEVICE FOR EXERCISING THE SKELETAL MUSCLES

This application is a National Stage completion of PCT/CA2013/050186 filed Mar. 12, 2013, which claims the benefit of U.S. Provisional application Ser. No. 61/609,720 filed Mar. 12, 2012.

FIELD OF THE INVENTION

This invention relates to exercise devices and equipment in US class 482 and US subclass 121 and specifically to an improved portable elastic resistance device for exercising skeletal muscles. This class provides for apparatus intended to be operated by a human user for the purpose of: (a) facilitating the conditioning or developing of a muscle of the user by repetitive or continuous activity of the user or, (b) participating in a track, field, gymnastic, or athletic activity, unless by analogy of structure or by other function the apparatus is classified elsewhere. The subclass provides for the utilization of resilient force resistance.

BACKGROUND OF THE INVENTION

Elastic based exercise technology has been available in various forms for a considerable period. Previous approaches have given us expensive, complex machinery and devices, or simple elastic devices that generate resistance along only one vector at a time, such as spring chest expanders, and various shock cord devices with one attachment to a fixed point, and the other end connecting to the user's body.

The two direction stretchable elastic "blankets" used in some exercise programs give more flexibility, as they can be stretched in both x and y axis simultaneously, but have two drawbacks. One, they are cut from sheet material to a fixed size and shape and two, they are not easily gripped by hands and feet.

There are numerous kinds of resistance devices which may be used as exercise and fitness equipment wherein such equipment is used for maintaining or rehabilitating certain muscle groups following surgery or injury. A resistance device may also be used for maintaining or achieving a desired fitness level. Various elaborate and specialized apparatus and devices are used effectively in gyms and fitness centers where movements are based on resistance to bungees or weights. However, due to space requirements for storage and use and also due to costs, such specialized devices are generally unavailable for home or private use in the office. Many persons prefer to exercise privately on their own schedules without traveling to a gym or fitness center desire to perform such exercises in their home or in the office. Many simple exercising devices are available for home use which substitute exercises for the routines which are commonly performed only with gym equipment. However, these devices tend to be restrictive in the types of exercises than can be performed and the muscle groups that can be exercised. Thus, there is an important need for an exercising device or kit which makes many common skeletal muscle exercises easy to perform in a private setting and is small enough and light weight enough to be easily moved to a desired location. It is also desirable that this device be easy and inexpensive to manufacture and purchase by the consumer. The device should also be readily collapsible for storage when not in use. Further, it is desirable to have an exercise or fitness device which can make a variety of typical resistance exercises possible with a single apparatus or exercise device. The present disclosure provides such an exercising device which solves those needs.

SUMMARY OF THE INVENTION

The invention consists of flexible hexagonal arrays composed of rigid plastic "pucks" that are sized and shaped for convenient gripping with the hands, and or pinning against floor or wall by other body parts (feet, knees, elbows, trunk, head, etc.). Each is connected to between 3 and 6 shock cord assemblies. These are located at 60 degree intervals around the "puck" circumference. Connecting at all six points at anyone "puck" requires three, or less, shock cord assemblies in array configurations; three are required at any interior "puck" and two, one or none at each edge "puck", depending on location, as the shock cord assemblies connect at both ends.

To assembly the exercise apparatus the user lays out "puck" half assemblies on a convenient horizontal surface forming equilateral triangles and/or hexagons to create an array of desired size and shape. The user then pushes the end pieces of an appropriate number of shock cord assemblies into the appropriate hollow voids within the inner face of the "puck" half assemblies. The user then snaps additional "puck" halves into place to close each "puck" and finish the array. The array is now ready to be used for exercising. When exercise is complete the array can readily be broken down for storage or configuration into a different array by prying open the "pucks" with a coin, fingernail, etc. at the indentations provided for that purpose.

In another embodiment the invention is an elastic resistance exercising apparatus for exercising skeletal muscles. The apparatus comprises a plurality of equilateral triangular elements assembled to form a configuration. Each the plurality of equilateral triangular elements comprises a tension element forming the sides and a puck assembly at each corner. In one configuration the apparatus is a triangle. In another configuration the apparatus is a parallelogram. In yet another configuration the apparatus is a polygon. In still another embodiment apparatus is a hexagon. A hole, or holes, can be left in the interior of larger arrays, if desired, to allow even greater variety of use.

The tension element comprises a length of shock cord having a first end and a second end. The first end and said second end are anchored to a first and second puck assembly a rectangular prisms. The shock cord first end and second end include a first end loop and a second end loop. The loops are fixed in place by a metallic crimp.

The rectangular prisms comprise a frustoconical aperture running from the top surface of the rectangular prism to the bottom surface. The aperture accepts the loops thereby providing an anchor for the tension element when the prisms are inserted into the puck assembly.

The puck assembly comprises a top half and an identical bottom half press fit together. The top half comprises a disc-shaped body having a downwardly curved upper surface having a bottom edge having a circumference and a bottom surface. The bottom edge includes a plurality of archways disposed equally around its circumference. Each archway has a radius greater or equal to the radius of the shock cord, but small enough to allow the end pieces of the shock cord plenty of bearing surface. The bottom surface includes a plurality of chambers adapted to receive rectangular prisms in a press-fit relationship. The bottom surface further comprises, alternatively, a pair of projections and a pair of receiving apertures that straddle the archways so that when the assembly top half is press fit with the assembly bottom half the projections mate with apertures of the assembly bottom half.

The arrays can be made up in any convenient size or configuration for exercise purposes and the smaller arrays arc light enough to be readily portable. By virtue of its uniform stretch resistance properties apparatus resistance will vary with the number of strands being stretched and the distance between gripping and/or pinning points. The distance between gripping points determines the length of bungee being stretched and gives the opportunity of exercising all of the skeletal muscles at a variety of resistance levels. For the purposes of this application and by way of example only, we will describe a few arrays and exercises, selected from a spectrum of possible exercise, which, we believe, is limited only by the imagination of the users.

Other objects, advantages and novel features of the present disclosure will become more apparent from the following detailed description when taken in conjunction with the accompanying drawings.

DESCRIPTION OF THE DRAWINGS

FIG. 6 is a diagram illustrating a desired array of bottom half puck assemblies awaiting assembly.

FIG. 7 is a diagram of the array of FIG. 6 with tension elements installed.

DESCRIPTION OF THE INVENTION

Figure 1:
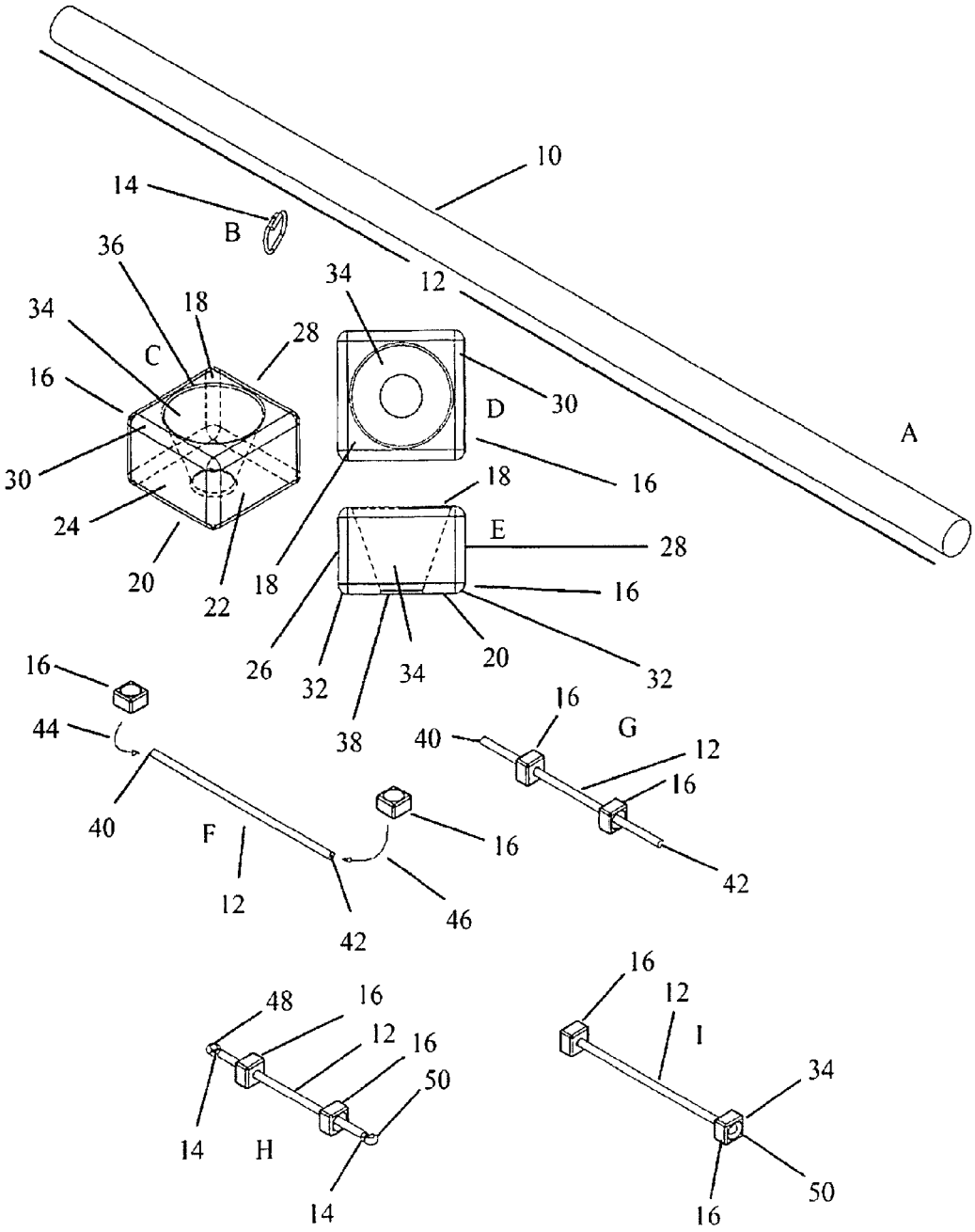
FIG. 1A is an illustration of a shock cord of one embodiment of the invention.
FIG. 1B is an illustration of a metallic crimp of one embodiment or the invention.
FIG. 1C is a perspective top view of a rectangular prism of one embodiment of the invention.
FIG. 1D is a top view of the prism of FIG. 1C.
FIG. 1E is a side view of the prism of FIG. 1C.
FIG. 1F is an assembly diagram for a tension element of one embodiment of the invention.
FIG. 1G is a further assembly diagram for the tension element of FIG. 1F.
FIG. 1H is a further assembly diagram for the tension element of FIG. 1F.
FIG. 1I is an assembled tension element of one embodiment of the invention.

Refer now to FIG. 1 and the views shown therein and labeled "A" through "I" inclusive. In view A, item 10 is a length of shock cord generally comprising industry standard nylon braid, covering rubber or equivalent elastic material. The cord is cut to desired length 12 which includes a folding and crimping allowance. The cord comprises one tension element of the invention.

Referring to view B, there is shown one embodiment of a metallic crimp 14 which is used to fix the ends of the cord in a looped configuration as shown in view H.

Referring now to views C, D and E there are illustrated a perspective view, top view and side view respectively of cord end block 16. The end block 16 comprises a generally rectangular prism. The top and bottom surfaces 18 and 20 of the rectangular prism are square shaped and the four sides of the prism 22 to 28 are rectangular in shape. The edges 30 and corners 32 of the prism are rounded to facilitate insertion and a friction fit within a receiving chamber as more fully described below. Transversing the prism from top surface 18 to bottom surface 20 is a frustoconical orifice 34 having an open top surface 36 that is larger in diameter than open bottom surface 38. The bottom open surface 38 diameter is at least as large as diameter of the shock cord 12 used so that it can pass through.

Referring now to views F and G to assemble one element of the invention a prism 16 is placed over each end 40 and 42 of the shock cord 12 as shown by arrows 44 and 46 so that the large diameter top surface 18 of the prism is disposed outward on the cord 12 and the smaller diameter bottom surface 20 of the prism is disposed inward on the cord 12.

Referring now to FIGS. H and I, once the prisms are disposed a suitable equal length from each end 40 and 42 of the cord the ends of the cord are folded over to form end loops 48 and 50 and then crimp 14 is used to fasten the respective ends of the cord 40 and 42 to the body of the cord 12. The prisms are then pulled to their respective ends of the cord so that the loops 48 and 50 are nested within their respective frustoconical orifices 34.

Figure 2:
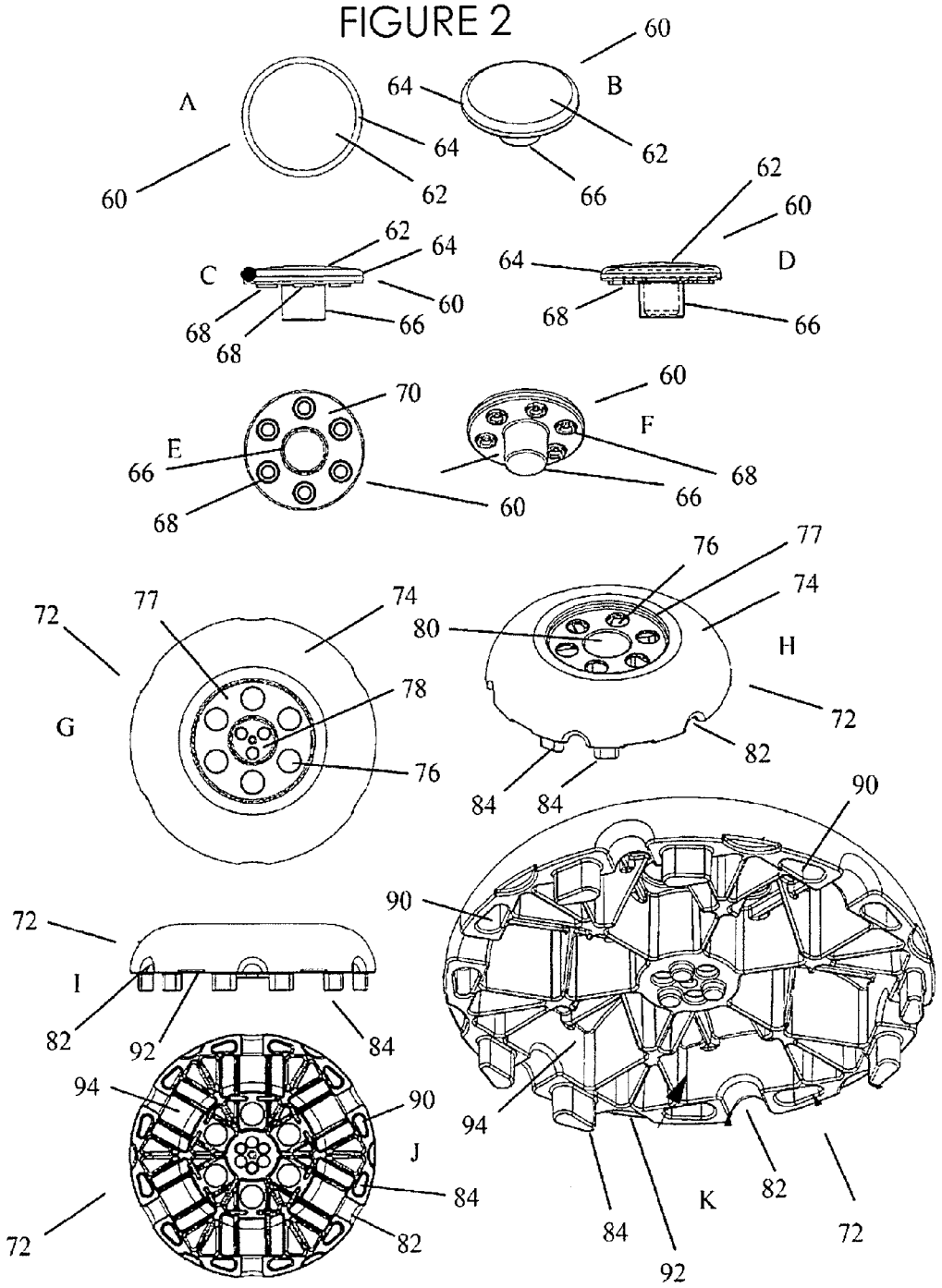
FIG. 2A is a top view or a cap piece to a top half puck assembly or one embodiment of the invention.
FIG. 2B is a perspective top view of the cap piece of FIG. 2A.
FIG. 2C is a side view of the cap piece of FIG. 2A.
FIG. 2D is a transparent view of the cap piece of FIG. 2C.
FIG. 2E is a bottom view of the cap piece of FIG. 2A.
FIG. 2F is a bottom perspective view of the cap piece of FIG. 2E.
FIG. 2G is a top view of a top half puck assembly of one embodiment of the invention.
FIG. 2H is a top perspective view of the top half puck assembly of FIG. 2G.
FIG. 2I is a side view of the top half puck assembly of the embodiment of FIG. 2G.
FIG. 2J is a bottom view of the top half puck assembly of FIG. 2I.
FIG. 2K is a bottom perspective view of the top half puck assembly of FIG. 2I.

Referring now to FIG. 2 and views A to J inclusive. Views A and B illustrate a puck cap piece in top and perspective side views. The cap piece comprises a top cover 62 and a hollow stem 66. The top cover is slightly curved. The edge 64 is also curved.

Referring now to views C and D there are shown a side view and transparent side view of the cap piece 60, top cover 62, curved edge 64 and stem 66. Projections 68 are also illustrated and their purpose further described below.

Referring to now views E and F there are shown a bottom view and bottom perspective view of the cap piece 60 comprising a hollow stem 66 and a plurality of projections 68 depending from the bottom surface 70 of the top cover 62.

Referring now to views G and H there are shown respectively a top view and a top perspective view of a top half 72 of a puck assembly used to connect the various tension elements of the invention to create a desired exercise array. The top half 72 comprises a disc-shaped body having a curved top surface 74 and a central well 77. Within the central well are a plurality of apertures 76 which are adapted to receive the plurality of projections 68 depending from the bottom surface 70 of the top cover 62 in a snap fit relationship. The central well further comprises a central aperture 80 which forms the top open surface or a receiving well 78 for receiving stem 66 of the top cap piece 60. View H illustrates projections 84 depending from the puck assembly top half 72 and straddling archway 82. These projections 84 are insened into corresponding receiving chambers 90 in the puck assembly bottom half as more fully explained below. The archway 82 provides passage for the tension element 12.

Figure 3:
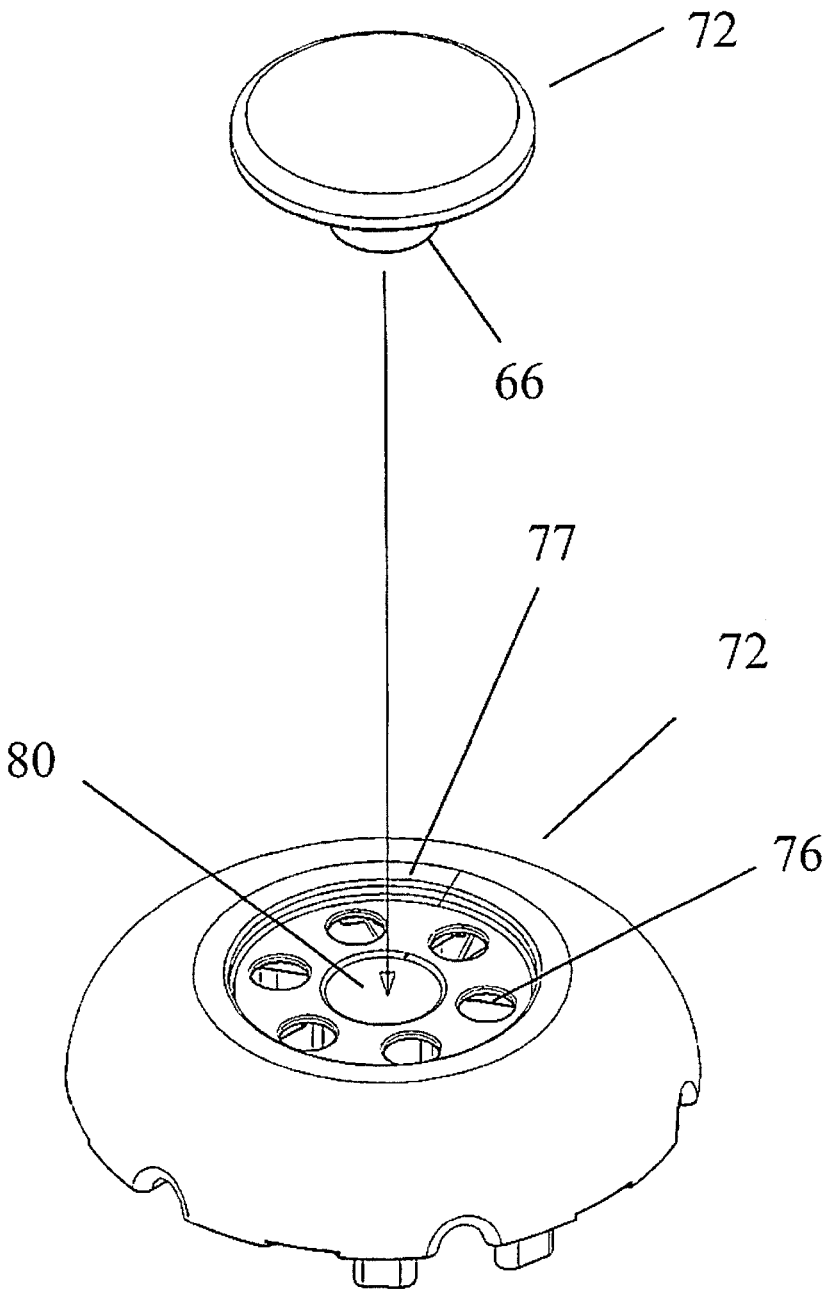
FIG. 3 is an assembly diagram of the cap piece to the top half puck assembly.

Referring now to views I, J and K there are shown a side view, bottom view and perspective bottom view of the puck assembly top half 72. Projections 84 depending from the puck assembly top half 72 snap fit into receiving chambers 90 in the puck assembly bottom half. Each archway 82 is straddled alternatively by projections 84 and receiving chambers 90. It is to be understood that the puck assembly bottom half is identical to the top assembly top half 72. Once the tension elements 12 are installed as illustrated below, the two puck half assemblies are snapped together so that projections 84 are received by chambers 90. The cap piece 60 is snap fit into receiving well 77 on the top of the two puck half assemblies of the so that stem 66 is received by well 78 and that projections 68 are received by apertures 76. This is illustrated in FIG. 3.

FIG. 2, views J and K also illustrate the receiving chambers 94 for the rectangular prisms 16. Also illustrated is indentation 92 which, when the two puck half assemblies are press fit together, permits the insertion of a blade or coin to pry the two half assemblies apart for disassembly or reconfiguration of the apparatus.

The two puck assembly halves are molded from a rubber material so that once assembled they can be comfortably gripped by the user when exercising with the apparatus.

Figure 4:
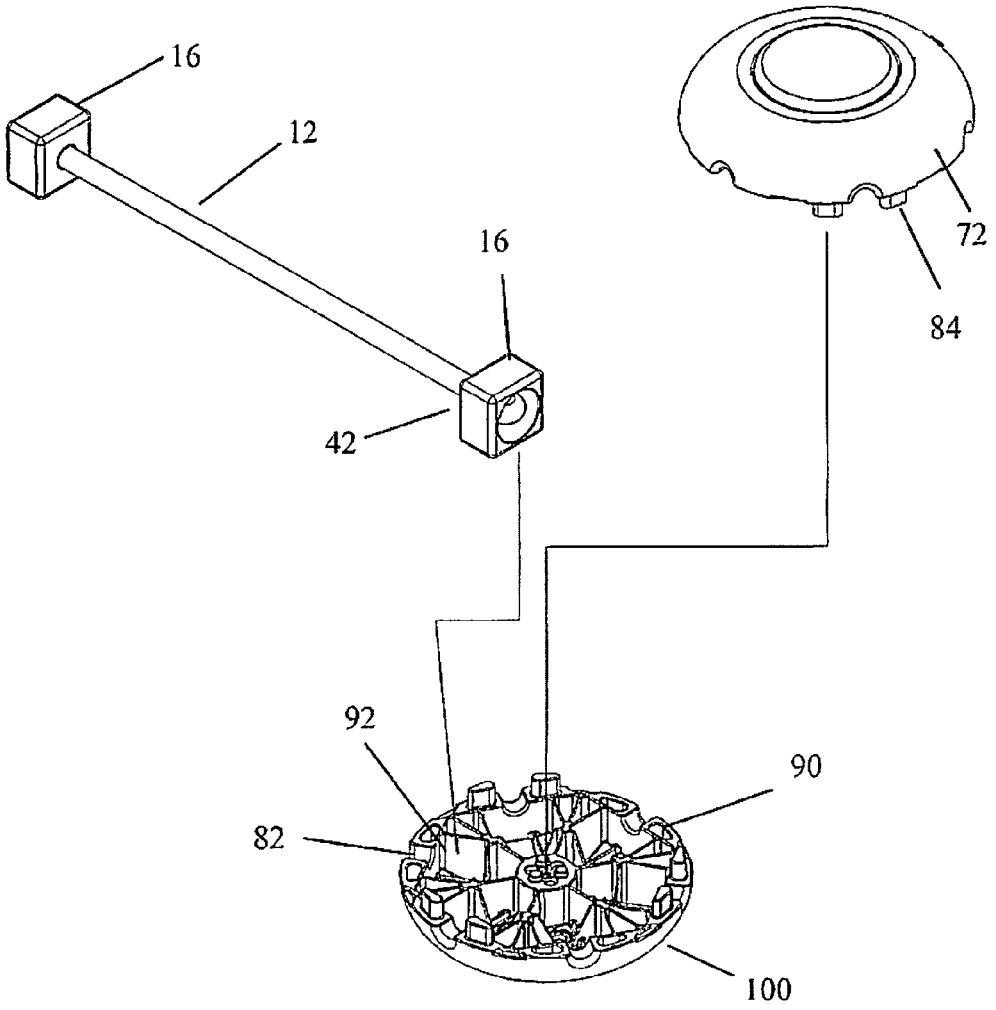
FIG. 4 is an assembly diagram of the tension clement to the top and bottom half puck assemblies.

Referring now to FIG. 4, there is illustrated the manner in which the tension elements 12 are installed within the bottom puck half assembly 100 and then covered by the top puck half assembly 72. As illustrated the rectangular prism 16 over tension element 12 and 42 is press fit into receiving chamber 92 within bottom half assembly 100 so that the tension element 12 is disposed within inverted arch 82. Top half assembly 72 is then press fit over bottom half assembly 100 so that projections 94 are received by chambers 90.

Figure 5:
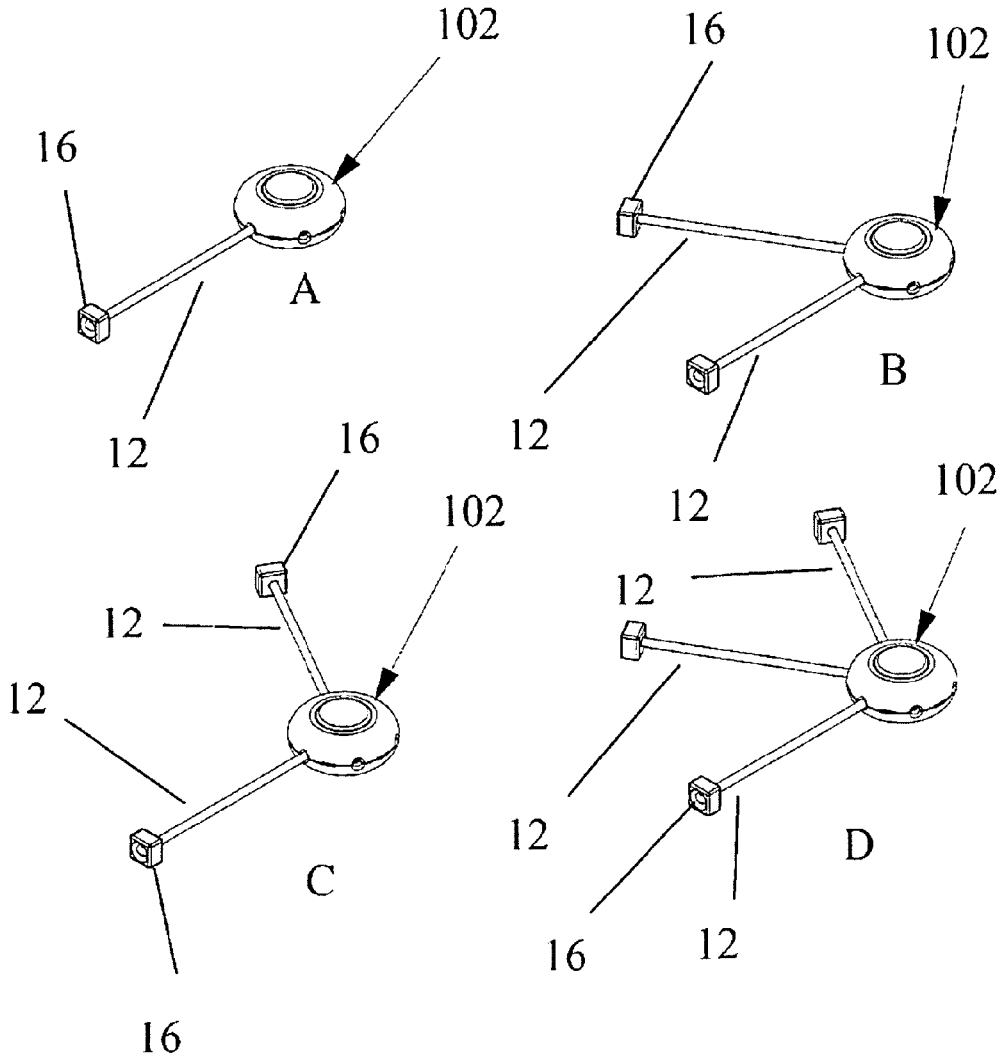
FIG. 5A is a diagram of an assembled puck assembly with single tension element.
FIG. 5B is a diagram of an assembled puck assembly and two tension elements.
FIG. 5C is a diagram of an assembled puck assembly and two tension elements at an approximately 120 degree angle.
FIG. 5D is a diagram of an assembled puck assembly and three equidistantly spaced tension elements.

Referring now to FIG. 5 there are illustrated views A to D of assembled puck assemblies 102 having one, two and three tension elements 12 protruding therefrom. The rectangular prism 16 on the end of each tension element is for connection to an adjacent puck assembly to create an array of puck assemblies.

Referring now to FIGS. 6 and 7 there is illustrated the method for assembling the components of the invention into an array to create one embodiment of the exercise apparatus. In FIG. 6 a plurality of puck assembly bottom halves 100 are laid out on a horizontal surface 120 to form a 3×3 array 122. In FIG. 7, the tension elements 12 are installed between each of the bottom half puck assemblies as illustrated by the connection between bottom half puck assemblies 101*a* and 101*b*. The rectangular prisms 16 are press fit into corresponding receiving chambers 94.

Figure 8:
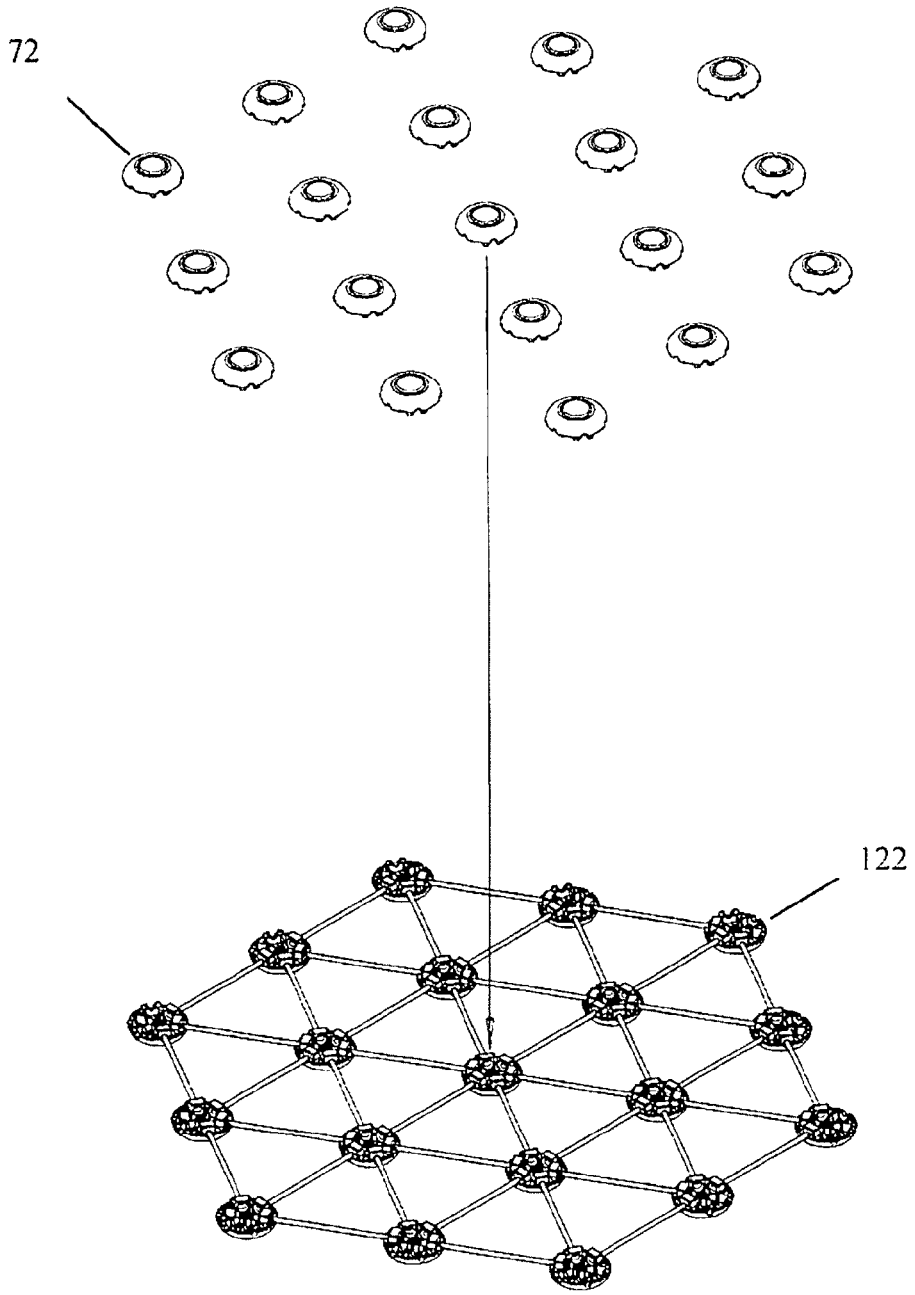
FIG. 8 is a diagram illustrating the installation of the top half puck assemblies onto the bottom half puck assemblies.
Figure 9:
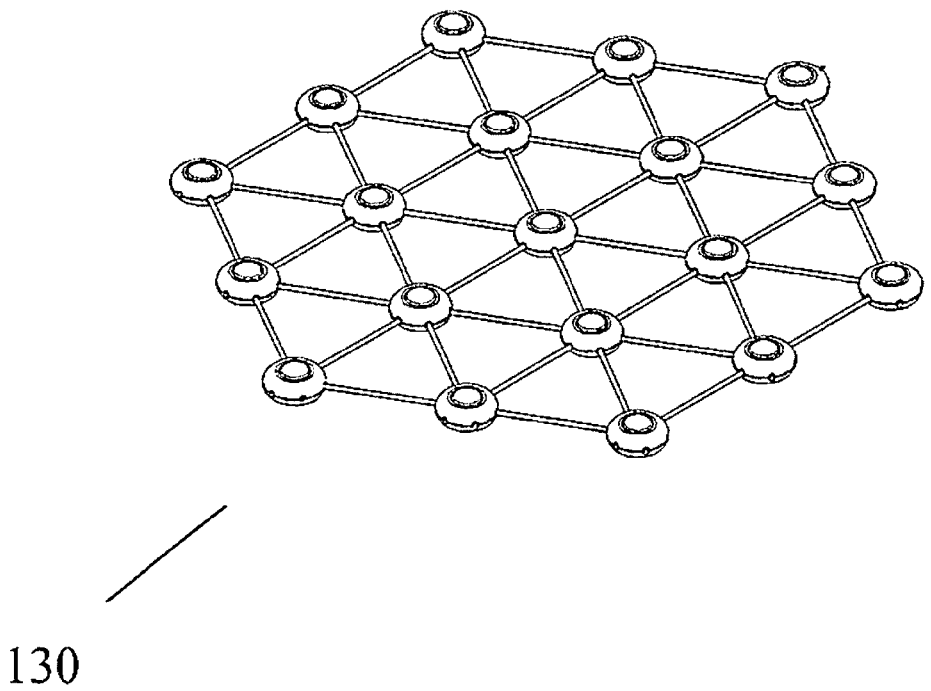
FIG. 9 is a completed assembly showing an exercise apparatus having a 3×3 hexagonal array of pucks.

Referring to FIG. 8, the top half assemblies 72 are then press fit onto the bottom half assemblies 122 to form the completed exercise apparatus having a 3×3 array as illustrated in FIG. 9 item 130.

Figure 10:
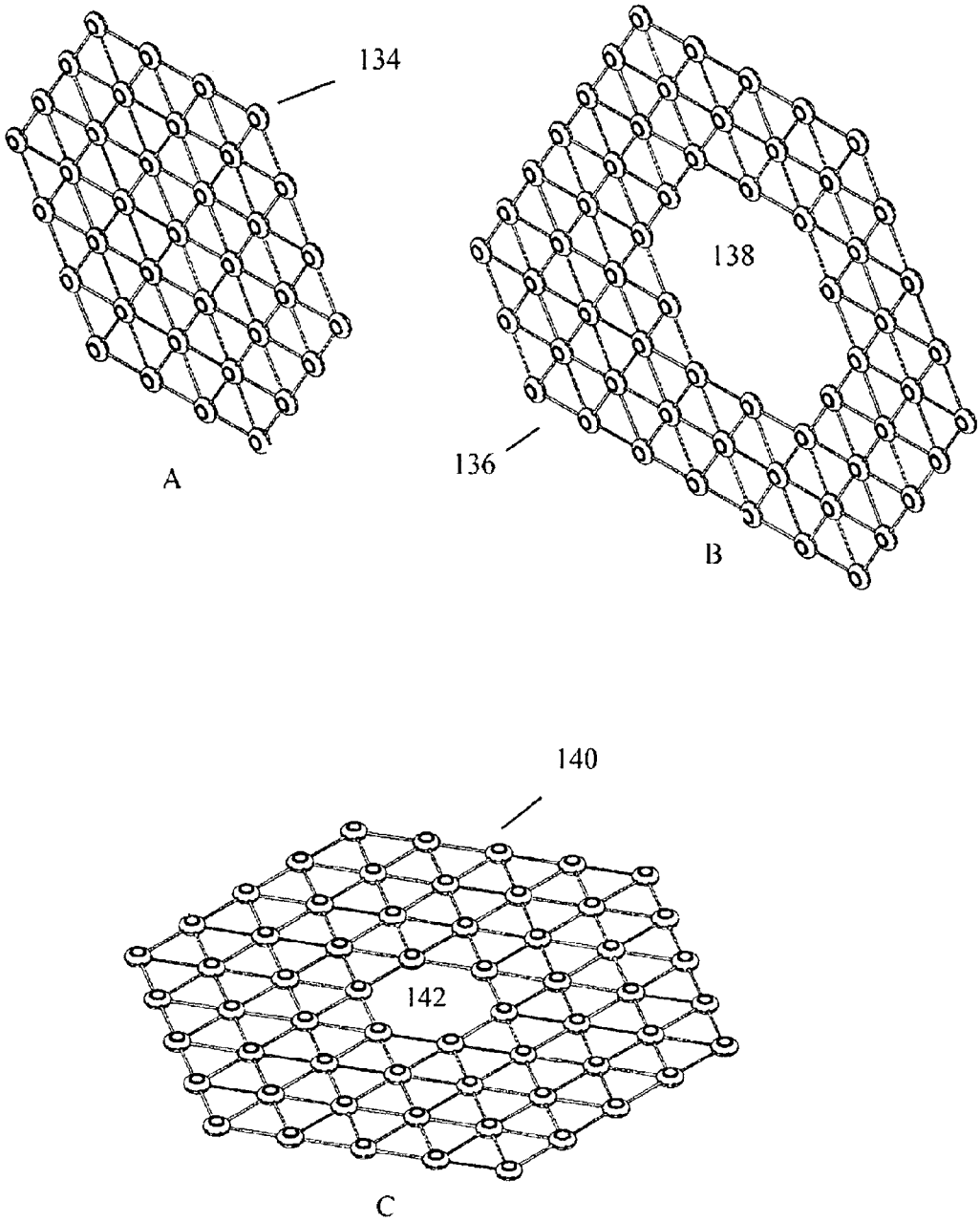
FIG. 10A illustrates a completed assembly of a 4×4 hexagonal array of pucks.
FIG. 10B shows a polygonal assembly of pucks with a gap.
FIG. 10C shows a 4×4 array of pucks with a central gap.

Referring now to FIG. 10 there are shown in views A, B and C different assembly configurations for the invention. View A illustrates an equal-sided 4×4 array 134. View B illustrates array 136 having unequal sides and a gap 138 in the array. View C illustrates an equal-sided 5×5 array 140 having a gap 140 in the array.

Figure 11:
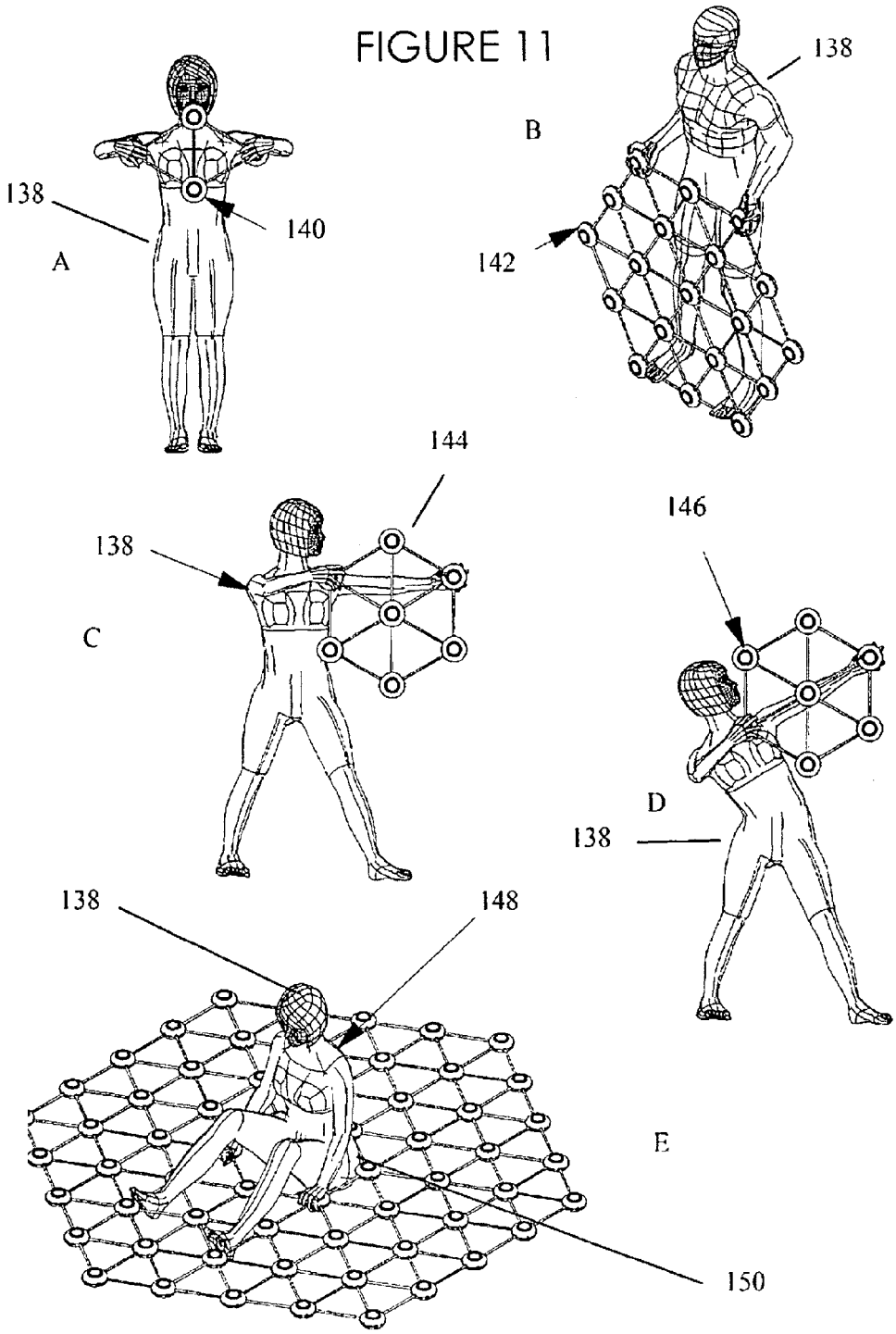
FIG. 11A illustrates one use of a 1×1 parallelogram array of pucks.
FIG. 11B illustrates one use of 3×3 hexagonal array of pucks.
FIG. 11C illustrates one use of a 2×2 hexagonal array of pucks.
FIG. 11D illustrates another use of a 2×2 hexagonal array of pucks.
FIG. 11E illustrates one use of a 5×5 hexagonal array of pucks having a central gap.

Referring to FIG. 11 there is illustrated in views A to E a variety of configurations of the invention used by a user 138 in various exercises. View A shows a 1×1 array 140. View B shows a 3×3 array 142. View C shows a 2×2 array. View D shows a 2×2 array and view E shows a 5×5 array having a gap 150 in the middle.

We claim:

1. An elastic resistance exercising apparatus for exercising skeletal muscles wherein said device comprises a plurality of equilateral triangular elements assembled to form a configuration and wherein each of said plurality of equilateral triangular elements comprises a tension element forming the sides thereof and a puck assembly at each corner thereof.

2. The apparatus of claim wherein said configuration is a triangle.

3. The apparatus of claim 1 wherein the configuration is a parallelogram.

4. The apparatus of claim 1 wherein the configuration is a polygon.

5. The apparatus of claim 1 wherein the configuration is a hexagon.

6. The apparatus of claim 1 wherein said tension element comprises a length of shock cord having a first end and a second end wherein said first end and said second end are anchored to a respective first puck assembly and a second puck assembly by a respective first and second rectangular prisms.

7. The apparatus of claim 6 wherein the shock cord first end and second end include a first end loop and a second end loop and wherein said first and second end loops are fixed in place by a metallic crimp.

8. The apparatus of claim 7 wherein said first and second rectangular prisms comprise a frustoconical aperture from a top surface of the first and second rectangular prism to the bottom surface of the rectangular prism.

9. The apparatus of claim 8 wherein said frustoconical aperture of the first and second rectangular prism accepts the first and second loops therein thereby providing an anchor for the tension element first and second ends.

10. The apparatus of claim 1 wherein said puck assembly comprises an assembly top half and an identical assembly bottom half press fit together.

11. The apparatus of claim 10 wherein said assembly top half comprises a disc-shaped body having a downwardly curved upper surface having a bottom edge having a circumference and a bottom surface.

12. The apparatus of claim 11 wherein said bottom edge includes a plurality of archways disposed equally around said circumference and wherein each of said plurality of archways has a radius equal to a radius of the tension element.

13. The apparatus of claim 12 wherein said bottom surface includes a plurality of chambers adapted to receive one of the first and second rectangular prisms in a press-fit relationship.

14. The apparatus of claim 13 wherein the bottom surface further comprises, alternatively, a pair of projections and a pair of receiving apertures that straddle the archways so that when the assembly top half is press fit with the assembly bottom half said pair of projections of the assembly top half mate with said receiving apertures of the assembly bottom half.

15. An elastic resistance exercising apparatus for exercising skeletal muscles wherein said device comprises a plurality of equilateral triangular elements assembled to form a configuration and wherein each of said plurality of equilateral triangular elements comprises a tension element forming the sides thereof and a puck assembly at each corner thereof; wherein, a. said tension element comprises a length shock cord having a first end and a second end wherein said first end and said second end are anchored to a respective first puck assembly and a second puck assembly by a respective first and second rectangular prisms;

b. the shock cord first end and second end include a first end loop and a second end loop and wherein said first and second end loops are fixed in place by a metallic crimp;

c. said first and second rectangular prisms comprise a frustoconical aperture from a top surface of the first and second rectangular prism to the bottom surface of the rectangular prism;

d. said frustoconical aperture of the first and second rectangular prism accepts the first and second loops therein thereby providing an anchor for the tension element first and second ends;

e. said puck assembly comprises an assembly top half and an identical assembly bottom half press fit together.

16. The apparatus of claim 15 wherein said assembly top half comprises a disc-shaped body having a downwardly curved upper surface having a bottom edge having a circumference and a bottom surface and wherein said bottom edge includes a plurality of archways disposed equally around said circumference and wherein each of said plurality of archways has a radius equal to a radius of the tension element.

17. The apparatus of claim 16 wherein said bottom surface includes a plurality of chambers adapted to receive one of the first and second rectangular prisms in a press-fit relationship and wherein the bottom surface further comprises, alternatively, a pair of projections and a pair of receiving apertures that straddle the archways so that when the assembly top half is press fit with the assembly bottom half said pair of projections of the assembly top half mate with said receiving apertures of the assembly bottom half.

* * * * *